US007780894B2

(12) United States Patent
Jones et al.

(10) Patent No.: US 7,780,894 B2
(45) Date of Patent: Aug. 24, 2010

(54) SYSTEM FOR DEFINING OPENINGS IN TILT-UP WALLS

(76) Inventors: Kurtis D. Jones, 13739 South 6315 West, Herriman, UT (US) 84065; Derrel L. Spencer, P.O. Box 640030, Bryce, UT (US) 84764

( * ) Notice: Subject to any disclaimer, the term of this patent is extended or adjusted under 35 U.S.C. 154(b) by 313 days.

(21) Appl. No.: 11/640,455

(22) Filed: Dec. 15, 2006

(65) Prior Publication Data

US 2007/0145640 A1 Jun. 28, 2007

Related U.S. Application Data

(60) Provisional application No. 60/752,667, filed on Dec. 21, 2005.

(51) Int. Cl.
*B28B 1/14* (2006.01)
*B28B 7/18* (2006.01)
*B28B 7/28* (2006.01)

(52) U.S. Cl. ..... 264/299; 249/142; 249/177; 249/184

(58) Field of Classification Search ..... 264/299; 249/142, 177, 184
See application file for complete search history.

(56) References Cited

U.S. PATENT DOCUMENTS

| | | | | |
|---|---|---|---|---|
| 1,212,654 | A | | 1/1917 | McKay |
| 1,754,638 | A | | 4/1930 | Mead |
| 3,648,962 | A | | 3/1972 | Farley |
| 3,712,576 | A | | 1/1973 | Dagiel |
| 4,042,205 | A | * | 8/1977 | Herrell ..... 249/189 |
| 4,159,098 | A | * | 6/1979 | Wong ..... 249/61 |
| 4,442,644 | A | | 4/1984 | Jukes |
| 4,545,163 | A | | 10/1985 | Asselin |
| 4,846,437 | A | | 7/1989 | Fitzgerald |
| 5,076,536 | A | | 12/1991 | Fitzgerald |
| 5,096,155 | A | | 3/1992 | Fitzgerald |
| 5,205,942 | A | | 4/1993 | Fitzgerald |
| 5,240,224 | A | | 8/1993 | Adams |
| 5,535,565 | A | | 7/1996 | Majnaric et al. |
| 5,562,272 | A | | 10/1996 | McAbee et al. |
| 5,577,353 | A | * | 11/1996 | Simpson ..... 52/92.2 |
| 5,616,271 | A | | 4/1997 | Podgurski |
| 5,833,872 | A | | 11/1998 | De Le fevre |
| 5,861,105 | A | | 1/1999 | Martineau |
| 5,997,792 | A | | 12/1999 | Gordon |
| 6,021,994 | A | | 2/2000 | Shartzer, Jr. |
| 6,164,615 | A | | 12/2000 | Basham |
| 6,250,033 | B1 | | 6/2001 | Zelinsky |
| 6,322,047 | B1 | | 11/2001 | Holmboe, Jr. |
| 6,568,651 | B2 | | 5/2003 | Reid |
| 6,702,247 | B2 | * | 3/2004 | Takagi ..... 249/189 |
| 7,455,803 | B2 | * | 11/2008 | Sanger ..... 264/334 |
| 2002/0145093 | A1 | * | 10/2002 | Shaw et al. ..... 248/235 |

* cited by examiner

*Primary Examiner*—Kat Wyrozebski
*Assistant Examiner*—Daniel Lee
(74) *Attorney, Agent, or Firm*—Morriss O'Bryant Compagni

(57) ABSTRACT

Disclosed is a tilt-up wall system that defines a space to receive a material, such as concrete. The system can include a plurality of forms and an opening system. The opening system defines the location of an opening that will receive a window, door, or other structure mountable or installable into the tilt-up wall. The opening system can include one or more corner assemblies, one or more spacer members, one or more lower supports, and one or more upper supports.

23 Claims, 3 Drawing Sheets

SYSTEM FOR DEFINING OPENINGS IN TILT-UP WALLS

CROSS-REFERENCE TO RELATED APPLICATIONS

This nonprovisional patent application claims benefit and priority under 35 U.S.C. §119(e) of U.S. Provisional Patent Application Ser. No. 60/752,667 filed Dec. 21, 2005, titled: "SYSTEM FOR DEFINING OPENINGS IN TILT-UP WALLS", the contents of which are incorporated herein by reference for all purposes.

BACKGROUND OF THE INVENTION

1. Field of the Invention

This invention generally relates to tilt-up wall construction, and more specifically to a system to create openings in a tilt-up wall.

2. The Relevant Technology

Concrete structures are routinely poured all over the world. These structures can include poured walls or solid, secured bases in which to build walls or other structures. In the United States, the walls of large commercial buildings are usually constructed using a tilt-up method. In such an approach, concrete walls or wall sections are formed on substantially flat, hard surfaces, such as a concrete floor of the building under construction. This surface is usually prepared with a suitable, bond-breaker material to prevent the newly formed wall or wall section from adhering to the floor.

Typically, forming the walls or wall sections requires a number of wood planks, such as two-by-eights, or the like, to define an area to receive concrete. The wood planks define the edges of the final wall or wall section. To provide smooth, beveled edges to the finished concrete wall or wall section, chamfers are often created by attaching triangular wood pieces to the form or wood planks. This is extremely labor intensive due to the difficulty involved in cutting the wood pieces and then nailing them to the wood planks.

A similar technique is used to create holes in the tilt-up wall to receive a window. For instance, a number of wood planks are mitered and then nailed together to create a form that defines the space within which a window will be placed at a later date. As with the wood planks forming the outer peripheral edge of the concrete wall, chamfers have to be attached to the window wooden planks in a similarly labor intensive manner.

Once the triangular pieces are attached to the window form and the general form for the wall, these forms are attached to the floor, so as to prevent dislocation or movement, particularly in a lateral direction. Once the forms have been arranged to create the defined area, the concrete mix is poured into the space. After curing and hardening the newly poured concrete, the wooden forms are removed and the concrete wall section is lifted from the floor by a crane or other suitable device to complete a wall section of the building.

During removal of the wooden forms, the planks and those triangular pieces used to form chamfers can be damaged. At least the triangular pieces, and more often both the wooden planks and the triangular pieces are damaged and must be discarded. For instance, cracking and splintering of the wood can occur, thus making the form unusable for creating new walls or wall sections. This not only wastes material, but can be a safety hazard because splintered wood can cause injury.

Different techniques have been employed to reduce the difficulty of creating the chamfers for the finished wall or wall section. In one attempt, an elongated base is used to support the wood plank and form the chamfer. The base includes a chamfered portion and a channel that receives the wood plank. Unfortunately, because the wood planks and the base have predetermined lengths, it is necessary to cut both the wood plank and the base to create the desired area to receive the concrete. This undesirably increases the time and costs required to construct the wall or wall sections. Further, the channel within which the wood plank mounts may become damaged, and thus incompletely receive the wood plank. Additionally, the wood plank may rest within the channel at an undesirable angle or orientation with respect to the surface upon which the wall or wall section will be formed. This can result in walls or wall sections having angled ends that cause adjacent walls or wall sections to abut incorrectly.

BRIEF SUMMARY OF THE INVENTION

An embodiment of an opening system for use in a tilt-up wall system is disclosed according to the present invention. The system may include corner assemblies and spacer members configured to cooperate with the corner assemblies. The system may further include lower supports configured for mounting on a surface and receiving the corner assemblies and spacer members in a rigid position to form an opening within a tilt-up wall system.

An embodiment of a tilt-up wall system is disclosed according to the present invention. The system may include forms defining an outer boundary of a tilt-up wall. The system may further include at least one opening system configured to define an opening within the outer boundary of the tilt-up wall. Each of the at least one opening systems may include corner assemblies and spacer members configured to cooperate with the corner assemblies. Each of the at least one opening systems may further include lower supports configured for mounting on a surface and receiving the corner assemblies and spacer members in a rigid position to form an opening within the tilt-up wall system.

An embodiment of a method of forming a tilt-up wall having an opening is disclosed according to the present invention. The method may include providing a tilt-up wall system such as described above. The method may further include securing the lower supports to the surface. The method may further include inserting the corner assemblies and spacer members. The method may further include placing the upper supports on top of the corner assemblies and spacer members. The method may further include arranging the forms around the opening system to define the outer boundary of the tilt-up wall. The method may further include pouring concrete into a region outside of the opening system and inside of the forms.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE INVENTION

The present invention relates to a system used to create an opening within a tilt-up wall that may receive a window, door, or other structure. The combination of the forms and the opening system creates a tilt-up wall having an opening configured to receive a structure, such as a window or door, at a later date. The forms define an outer boundary for the tilt-up wall, while the opening system defines the location of the opening by defining an inner boundary of the tilt-up wall.

Figure 1:
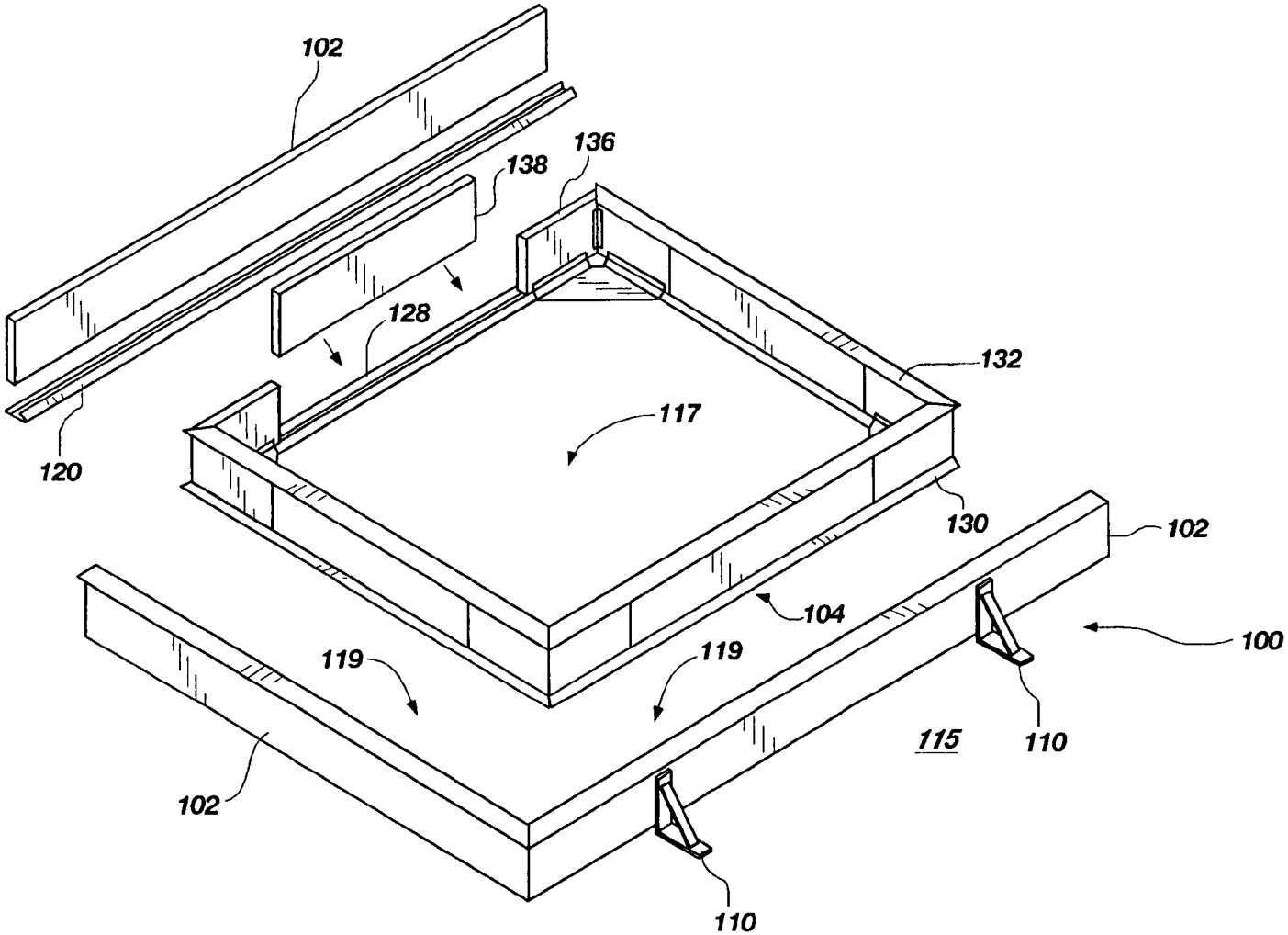
FIG. 1 illustrates a perspective view of one exemplary embodiment of the system according to the present invention.

Illustrated in FIG. 1 is a tilt-up wall system 100 that may include one or more forms 102 and an opening system, generally designated by reference numeral 104. Each form 102 may have a generally tubular or hollow configuration. Alternatively, each form 102 may be generally solid according to another embodiment of the present invention. The forms 102 aid with defining a space within which concrete or other material is to be received. One or more forms 102 are used to create a structured layout of a space to receive concrete or other material.

Generally, each form 102 may be an aluminum tubular member. This allows the length of the form 102 to be easily changed by cutting the form 102 to a desired length. The aluminum does not splinter or crack like the conventional wood planks currently used for tilt-up wall forms. Although reference is made to the form 102 being an aluminum tubular member, the form 102 can be plastic, metal, alloy, composites, or any other material having the desired rigidity and strength, whether or not such materials are used to form a tubular or solid structure according to alternative embodiments of the present invention.

The form 102 may be fabricated from one or more sections that connect together to create the desired structure. For instance, one or more forms 102 may be used to define any side of the space to receive the concrete or material. In addition, the form 102 may have various cross-sectional areas or dimensions. In one configuration, the form 102 has cross-sectional dimensions of about two inches by about twelve inches. In another configuration, the form 102 may have cross-sectional dimensions of one and one eighth inches by eleven and one eighth inches, one and one quarter inches by eleven and seven eighth inches, or any other cross-sectional dimensions larger or smaller than those described herein, depending upon the type of material used to make form 102. The form 102 can have various lengths, such as but not limited to from about one foot to about twelve feet in length. It will be understood that lengths lesser than one foot and greater than twelve feet are also possible, depending upon the particular configuration of the tilt-up wall or other structure to be constructed using the forms 102.

To maintain the forms 102 in a desired position upon a surface upon which the tilt-up wall is to be constructed, one or more positioning brackets 110 may be used to mount to a form 102 and the surface 115, such as a generally flat concrete floor of a building under construction or some other flat surface, upon which the tilt-up wall will be poured. These positioning brackets 110 may be disposed about the periphery of the forms 102 and attach to the surface 115 to prevent longitudinal and/or lateral movement of the forms 102. For simplicity, only a few positioning brackets 110 are illustrated in FIG. 1; however, it will be understood that the positioning brackets 110 may be mounted to each form 102 of the system 100.

Figure 2:
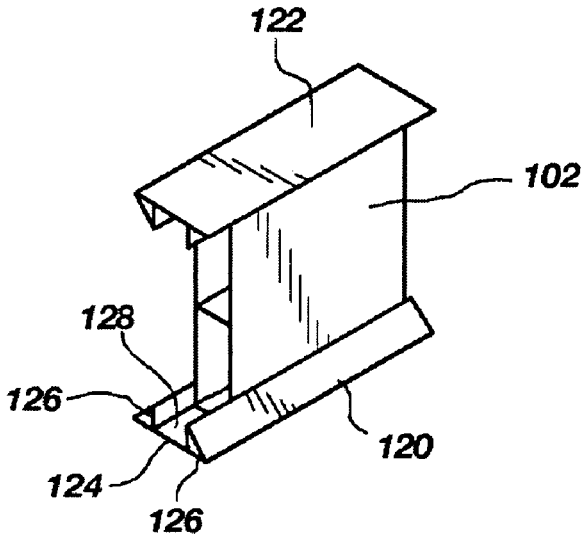
FIG. 2 illustrates a partial perspective view of a form of the system of FIG. 1 according to the exemplary embodiment present invention.

In another configuration, also illustrated in FIG. 1, lateral and longitudinal movement of the forms 102 may be controlled by a lower support 120, either alone or in combination with an upper support 122 (FIG. 2). The lower support 120 may mount to a surface 115, such as a generally flat concrete floor of a building under construction or some other flat surface, and receive the forms 102. To further prevent lateral and longitudinal movement of the forms 102, and as illustrated in FIG. 2, an upper support 122 may also be mounted on top of forms 102.

Illustrated in FIG. 2 is one configuration of the lower support 120 and the upper support 122. In the illustrated configuration of FIG. 2, the lower support 120 and the upper support 122 have generally the same configuration so that each may be interchangeably used. It will be understood by those skilled in the art that the lower support 120 and the upper support 122 may have varying configurations. For ease of discussion, reference will be made to the structural features of the lower support 120. However, it will be understood that such structural features of the lower support 120 may apply equally to upper support 122.

As illustrated in FIG. 2, the lower support 120 includes a base 124 having two angular portions 126. The angular portions 126 of the lower support 120 provide a volume for creating a desired chamfer on the finished tilt-up wall (not shown). The angular portions 126 are spaced apart to create a channel 128 that extends longitudinally along the lower support 120. This channel 128 is configured to receive and securely retain a portion of the form 102. In one configuration, the channel 128 is configured to create an interference fit with a portion of the form 102, although this need not be the case.

In the illustrated configuration, the lower support 120 and/or the upper support 122 can be fabricated from a single member that is bent into the desired configuration. In another configuration, the lower support 120 and/or the upper support 122 can be an extruded member with the desired shape. It will be understood that, in still another configuration, numerous pieces can be joined, attached, or otherwise connected together to create the desired configuration of the lower support 120 and/or the upper support 122.

As with the form 102, the lower support 120 and the upper support 122 can be fabricated from extruded aluminum. This allows the length of the supports 120 and 122 to be easily changed through cutting. The aluminum does not splinter or crack as the typical wood structures would. Although reference is made to the lower support 120 and the upper support 122 being fabricated from aluminum, the supports 120 and 122 may be formed of plastic, metal, alloy, composites, or any other material having the desired rigidity and strength, whether or not such materials are used to form a tubular or solid structure according to other embodiments of the present invention.

Returning to FIG. 1, illustrated is one exemplary configuration of the opening system 104. As shown, the opening system 104 is a multi-piece system that can be used to create variously sized openings, shown generally at 117, within a tilt-up wall. As shown in FIG. 1, the opening system 104 includes a lower support 130, an upper support 132, a number of corner assemblies 136, and one or more spacer members 138. The lower support 130 and the upper support 132 may have similar configurations and structural features to those of the lower support 120 and the upper support 122 discussed above. For instance, the lower support 130 can mount to a surface 115, such as a generally flat concrete floor of a building under construction or some other flat surface. The lower support 130 also provides a secure attachment point for the one or more corner assemblies 136 and the one or more spacer members 138.

In addition to supporting one or more corner assemblies 136 and spacer members 138, the lower support 130 also aids with aligning the corner assemblies 136 and the spacer members 138 so that the opening 117 will be square, i.e., the corners are substantially at 90 degrees. The upper support 132 also aids with aligning each of the corner assemblies 136 and the spacer members 138 so that the opening system 104 creates a square opening 117, i.e., the corners are substantially at 90 degrees, for receiving a window, door, etc. (not shown). It will be understood, however, that openings 117 having different corners with different angular orientations greater or lesser than 90 degrees are also possible, depending upon the particular implementation of lower supports 130, upper supports 132, and corner assembly 136.

In addition to supporting and aligning the corner assemblies 136 and the spacer members 138, the lower support 130 and the upper support 132 also aid with creating a chamfered or angled edge to the completed tilt-up wall. For instance, it is usually desirable to have a chamfered edge or angled portion about the opening 117 in a tilt-up wall that is to receive a window, door, or other structure. The lower support 130 and the upper support 132 create this chamfered edge or angled portion without the need to nail additional pieces of material, such as wood, to any of the corner assemblies 136 or the spacer members 138. This feature is an advance over the prior art and also reduces the time required for construction of a tilt-up wall. This feature also eliminates much of the waste, i.e., non reusable materials, associated with forming openings 117 in tilt-up walls.

As with the lower support 120, the lower support 130 may include a base portion, angular portions, and a channel separating the angular portions. Unlike the lower support 120 that was described as receiving the form 102 within the channel, the lower support 130 can receive a portion of the corner assembly 136 and/or the spacer member 138. However, it will be understood that the size and shape of lower portions of the corner assembly 136, spacer member 138 and form 102 may be identical. For this reason, the lower supports 120, 130 and the upper supports 122, 132 may all have identical channel 128 dimensions according to one embodiment of the present invention.

Figure 3:
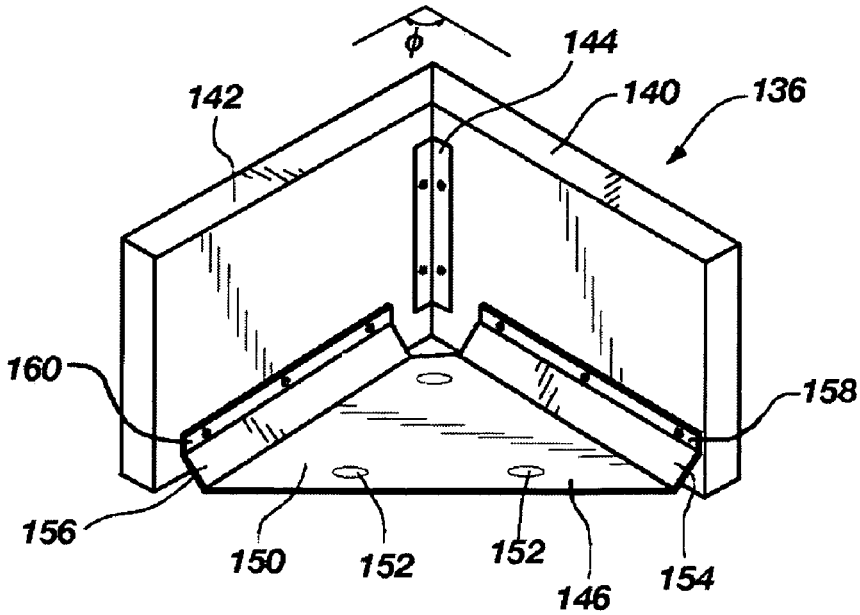
FIG. 3 illustrates a perspective view of a corner assembly of the system of FIG. 1 according to the exemplary embodiment of the present invention.

Turning now to FIG. 3, illustrated is one configuration of the corner assembly 136. As shown, the corner assembly 136 includes a first corner member 140 and a second corner member 142. These corner members 140 and 142 may have a similar configuration to the spacer member 138, except that one end of each corner member 140 and 142 is angularly cut or mitered, such that when the first corner member 140 and the second corner member 142 mount together, the first corner member 140 and the second corner member 142 are angularly oriented to one another at 90 degrees. Of course in other embodiments, corner members 140 and 142 may be joined in a butt joint (not shown in FIG. 3). It will also be understood that depending upon the particular use of the present invention, such as outside the use with creating openings in tilt-up walls, the angular orientation of the first corner member 140 relative to the second corner member 142 may be greater or lesser than 90 degrees as required for a particular application.

To aid with supporting the mounting of the first corner member 140 to the second corner member 142, an angle bracket 144 may be mounted to both the first corner member 140 and the second corner member 142. This angle bracket 144 can be mounted to the corner member 140 and the corner member 142 using rivets, screws, nails, fasteners, chemical adhesives, or other techniques for mounting one member to another. In addition to the angle bracket 144, a lower bracket 146 may also be mounted to the first corner member 140 and the second corner member 142. This lower bracket 146 may be used to locate the corner assembly 136 to the surface upon which the opening system 104 rests.

As illustrated in FIG. 3, the lower bracket 146 may include a mounting portion 150 having a number of apertures 152 through which fasteners (not shown) may be inserted to mount the mounting portion 150 to the surface 115 described above (FIG. 1). A first portion 154 and a second portion 156 extend from the mounting portion 150. Both the first portion 154 and the second portion 156 may extend angularly from the mounting portion 150 as shown in FIG. 3.

In FIG. 3, the first portion 154 may include a lip 158 that mounts to the corner member 140. Similarly, the second portion 156 may include a lip 160 that mounts to the corner member 142. In this particular configuration, the angular orientation of the first portion 154 and the second portion 156 is such that one of the angular portions 126 (FIG. 2) can be received within the space defined or bounded (i) by the first portion 154 and the corner member 140 and (ii) between the second portion 156 and the corner member 142. In this configuration, the corner assembly 136 aids in securely retaining the lower support 130 in the desired position. Furthermore, the lower support 130 aids with placement of the corner assembly 136. Furthermore, lips 158, 160 may extend from first and second portions 154, 156, respectively. According to another embodiment, lips 158 and 160 may extend perpendicularly and directly from mounting portion 150 (embodiment not shown in FIG. 3). As with mounting the angle bracket 144 to the first corner member 140 and the second corner member 142, the lower bracket 146 may be mounted to the first corner member 140 and the second corner member 142 using rivets, nails, fasteners, screws, welds, chemical bonds, or other techniques known to those skilled in the art for attaching one member to another.

Returning to FIG. 1, one or more spacer members 138 can be used to fill any spaces between spaced apart corner assemblies 136. These spacer members 138 can be generally elongated members that can have a similar configuration to form 102, the first corner member 140, and/or the second corner member 142. Rather than one end having an angular portion, each of the spacer members 138 can have generally planar ends, so that they securely abut the ends of the first corner member 140 and/or the second member 142. It will be understood, however, that one or both of the ends of the spacer members 138 can be configured to interlock with at least one corner assembly 136 and/or an adjacently positioned spacer member 138 by using inserts or other structures known to those skilled in the art.

The spacer members 138 may be generally formed of elongated aluminum members that have the desired strength and rigidity for use with concrete. Although aluminum is one configuration of a metal suitable to fabricate the spacer members 138, the lower support 130, the upper support 132, and the corner assembly 136, it will be understood that various other materials can be used, such as but not limited to other metals, synthetic materials, plastic material, natural materials, or the like. Similarly, though spacer members 138 have been described as generally hollow aluminum structures, it will be understood that solid structures may be used in other configurations or embodiments consistent with the present invention.

In use, the opening system 104 can be easily used to create the desired opening 117 within a tilt-up wall. At a starting point of defining the location of the opening in the tilt-up wall, the lower supports 130 can be mounted to the surface 115 upon which the tilt-up wall will be poured or created. With the lower support 130 sized to the desired opening and aligned so that the corners of the opening 117 are at the desired angular orientation, the corner assemblies 136 can be inserted into the channel 128 in lower supports 130 configured for receiving the corner assemblies 136 and spacer members 138. As the corner assemblies 136 are mounted in the channels 128 of the respective lower supports 130, the corner assembly 136 aids to maintain alignment of the lower supports 130 and prevent unwanted movement. With the corner assemblies 136 in place, the distance between spaced apart corner assemblies 136 can be measured, and appropriately aligned spacer members 138 inserted. It will be understood that any space between spaced apart corner assemblies 136 can be filled using one or more spacer members 138. These spacer members 138, and optionally the corner assembly 136, can be mounted to the lower support 130 using fasteners, adhesives, silicone, or the like as described herein.

Once the corner assemblies 136 and the spacer members 138 are in place, the upper support 132, having a similar configuration to the lower support 130, may be mounted to the exposed upper surface of the corner assemblies 136 and the spacer members 138 for additional support. More specifically, the channel 128 of the upper support 132 may receive portions of the corner assembly 136 and the spacer members 138. With this configuration, the angular portions 126 extend downwardly towards the lower support 130 and will thus provide a chamfered edge to the opening 117 that mirrors the chamfered edge provided by angular portions 126 on the lower support 130. As with mounting the corner members 136 and the spacer members 138 to the lower support 130, adhesives, mechanical fasteners, or other techniques known to those skilled in the art may also be used to mount the upper support 132 to the corner assemblies 136 and the spacer members 138.

With the completed opening system 104 in place, whether before or after placing the forms 102 to define the outer boundary of the tilt-up wall (optionally using a similar technique to that described above with respect to opening system 104, i.e., mounting of the forms 102 to lower supports 130 and upper supports 132 to define the boundaries for the tilt-up wall), concrete can be poured in the space, shown generally at arrows 119, between the opening system 104 and the outside walls defined by forms 102 for the tilt-up wall. As the concrete is poured and rises within the space 119, the opening 117 will take upon the configuration or profile presented by the lower support 130, the upper support 132, the corner assemblies 136, and the spacer members 138.

By selectively choosing the height of forms 102, corner assemblies 136, and spacer members 138, the above-described system may be used to form tilt-up walls with selective thickness, according to one embodiment of the present invention. According to an alternative embodiment, a secondary spacer member (not shown) may be disposed within the channel 128 prior to insertion of the forms 102, the corner assemblies 136 and/or the spacer members 138 to provide additional height and resulting thickness of the tilt-up wall. This secondary spacer member (not shown) may be inserted in either or both of the lower support and the upper support. By doing so, the secondary spacer member (not shown) may be used to increase the overall height of the forms 102, corner assemblies 136, and spacer members 138. The secondary spacer member (not shown) may be configured to engage an edge of the forms 102, spacer members 136 and first and second corner members 140, 142 using attachment means known to those of ordinary skill in the art. This alternative embodiment employing secondary spacer members (not shown) enables a user of the system 100 to accommodate for differing tilt-up wall thicknesses without the need to purchase forms 102, corner assemblies 136, and spacer members 138 of varying heights.

Through use of the present invention, many of the problems with current techniques are eliminated. For instance, during breakdown, no splintering or damage to the components may occur, because the lower supports 120 and 130, the upper supports 122 and 132, the corner assemblies 136, and the spacer members 138 are all fabricated from materials other than wood.

Referring again to FIGS. 1-3, a particular embodiment of an opening system 104 for use in a tilt-up wall system 100 is shown. The opening system 104 may include corner assemblies 136 and spacer members 138 configured to cooperate with the corner assemblies 136. The opening system 104 may further include lower supports 130 configured for mounting on a surface 115 and receiving the corner assemblies 136 and spacer members 138 in a rigid position to form an opening 117 within a tilt-up wall system 100.

According to another embodiment of the opening system 104, the corner assemblies 136 each comprise two corner members 140, 142 configured for being joined in a miter joint (shown in FIG. 3) or a butt joint (not shown). According to another embodiment of the opening system 104, the corner assemblies 136 may each further include a lower bracket 146 configured to rigidly hold the two corner members 140, 142 at a selected angle with respect to each other. Furthermore, the lower bracket 146 may further be configured for mounting to the surface 115. The selected angle, $\phi$, may be approximately 90 degrees according to one embodiment. The selected angle, $\phi$, may be more or less than 90 degrees according to other embodiments.

According to another embodiment, the lower bracket 146 may include a substantially planar mounting portion 150 having apertures 152 for use in mounting to the surface 115. According to another embodiment, the lower bracket 146 may further include first and second portions 154, 156, each extending at an angle from the mounting portion 150 and ending in a lip 158, 160. The lips 158, 160 may be configured for mounting against the corner members 140, 142. The lips 158, 160 may further be configured in the selected angle, $\phi$, with respect to each other. According to an alternative embodiment, the lower bracket 146 may include lips (not shown) extending substantially perpendicularly from the mounting portion 150. According to this embodiment, the lips (not shown) may be configured for mounting against the corner members 140, 142 and also in the selected angle, $\phi$, with respect to each other.

According to another embodiment, the corner assemblies 136 may further include an angle bracket 144 configured to rigidly hold the two corner members 140, 142 at the selected angle, $\phi$, with respect to each other. In another embodiment of the opening system 104, the spacer members 138 each may include substantially rectangular cross-sectioned structures having selectable length. According to another embodiment of the opening system 104, the spacer members 138 may be formed of substantially hollow aluminum structures.

According to another embodiment of the opening system 104, the lower supports 130 each may include a channel 128 for receiving an edge of a spacer member 138 or a corner assembly 136. According to yet another embodiment of the opening system 104, the lower supports 130 may each include angular portions 126 configured for forming a chamfer along an edge of the opening 117. According to yet another embodiment, the opening system 104 may further include upper supports 132. Each upper support 132 may also include a channel 128 for receiving an edge of a spacer member 138 or a corner assembly 136.

Referring again to FIGS. 1-3, a particular embodiment of a tilt-up wall system 100 is shown according to the present invention. The system 100 may include forms 102 defining an outer boundary of a tilt-up wall (not shown). The system 100 may further include at least one opening system 104 configured to define an opening 117 within the outer boundary of the tilt-up wall (not shown). Each of the at least one opening systems 104 may include corner assemblies 136 and spacer members 138 configured to cooperate with the corner assemblies 136. Each of the at least one opening systems 104 may further include lower supports 130 configured for mounting on a surface 115 and receiving the corner assemblies 136 and spacer members 138 in a rigid position to form an opening 117 within the tilt-up wall system 100.

The embodiment of a tilt-up wall system 100 may further include upper supports 132 configured for receiving the corner assemblies 136 and spacer assemblies 138 opposite the lower supports 130. According to another embodiment of a tilt-up wall system 100 the upper supports 132 and the lower supports 130 may each include angular portions 126 configured to form a chamfer along an edge of the opening 117. According to yet another embodiment of a tilt-up wall system 100, the corner assemblies 136 may each comprise two corner members 140, 142 configured for being joined in a miter joint (as shown in FIGS. 1 and 3) or a butt joint (not shown). While a butt joint is not illustrated, it will be readily understood by one of ordinary skill in the art to be an equivalent alternative to the miter joint shown in FIGS. 1 and 3. According to still another embodiment of a tilt-up wall system 100, the corner assemblies 136 may each further include a lower bracket 146 and an angle bracket 144. According to one embodiment, the lower bracket 146 may be further configured to rigidly hold the two corner members 140, 142 at a selected angle, $\phi$, with respect to each other. According to another embodiment, the lower bracket 146 may also be configured for mounting to the surface 115.

According to another embodiment, selected angle, $\phi$, may be approximately 90 degrees. It will be understood that the selected angle, $\phi$, may be other angles as well, i.e., more or less than 90 degrees. According to another embodiment of the tilt-up wall system 100, the lower bracket 146 may include a substantially planar mounting portion 150 having apertures 152 for use in mounting to the surface 115. According to yet another embodiment of the tilt-up wall system 100, the lower bracket 146 may further include first and second portions 154, 156, each extending at an angle (not marked on FIG. 3) from the mounting portion 150 and ending in a lip 158, 160, wherein the lips 158, 160 are configured for mounting against the corner members 140, 142. The lips 158, 160 may further be configured in the selected angle, $\phi$, with respect to each other, according to another configuration of the present invention.

Figure 4:
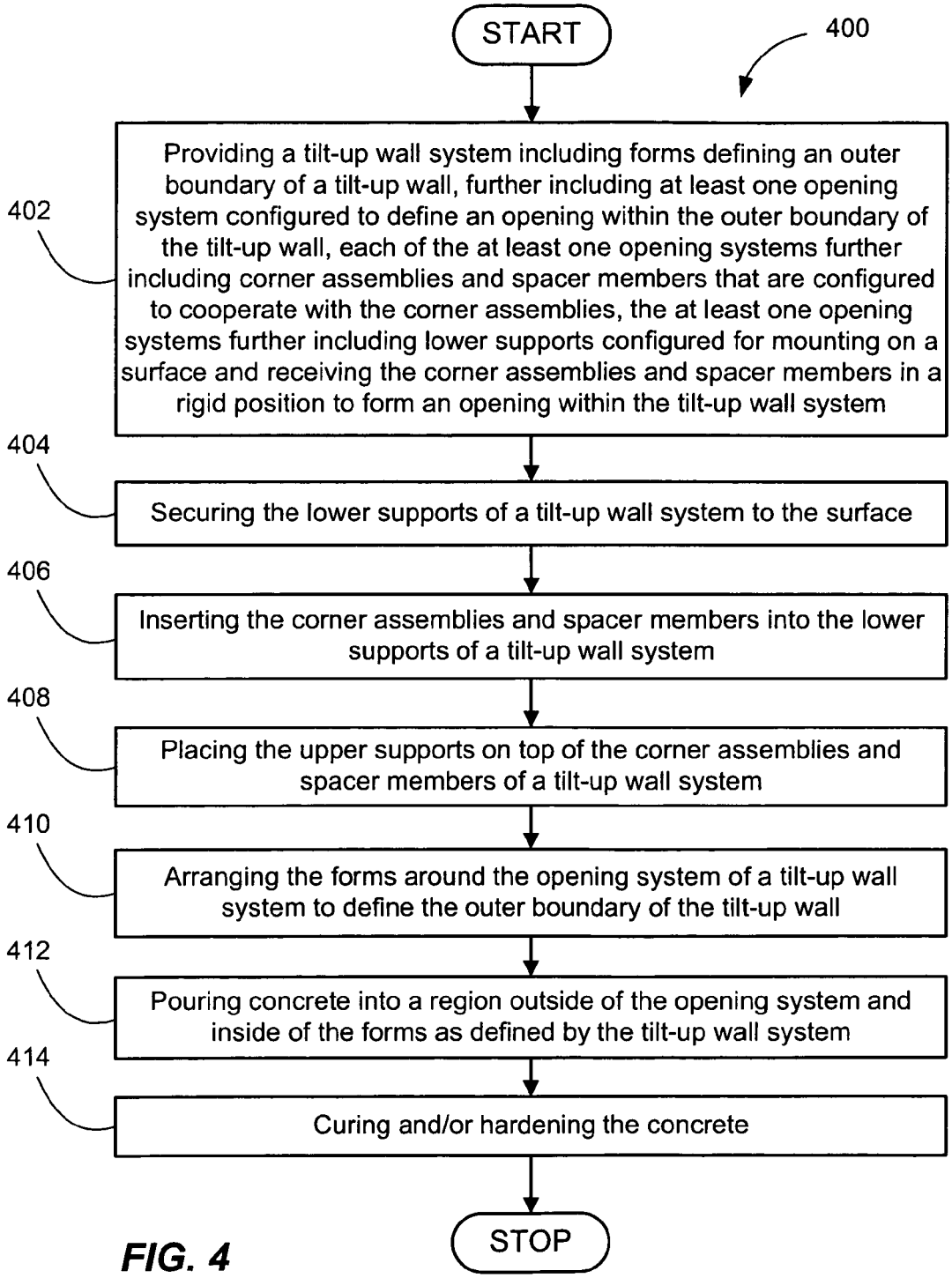
FIG. 4 is a flowchart of an embodiment of a method of forming a tilt-up wall having an opening, according to the present invention.

FIG. 4 is a flowchart of an embodiment of a method 400 of forming a tilt-up wall having an opening, according to the present invention. Method 400 may include providing 402 a tilt-up wall system 100 such as described above. The method may further include securing 404 the lower supports 130 of a tilt-up wall system 100 to the surface 115. Method 400 may further include inserting 406 the corner assemblies 136 and spacer members 138 into the lower supports 130 of a tilt-up wall system 100. Method 400 may further include placing 408 the upper supports 132 on top of the corner assemblies 136 and spacer members 138 of a tilt-up wall system 100. Method 400 may further include arranging 410 the forms 102 around the opening system 104 of a tilt-up wall system 100 to define the outer boundary of the tilt-up wall. Method 400 may further include pouring 412 concrete into a region 119 outside of the opening system 104 and inside of the forms 102 as defined by the tilt-up wall system 100. Method 400 may further include curing and/or hardening 414 the concrete.

The present invention may be embodied in other specific forms without departing from its spirit or essential characteristics disclosed herein. The described embodiments are to be considered in all respects only as illustrative and not restrictive. Various other configurations may be understood by those skilled in the art based upon the material disclosed herein. The scope of the invention is therefore indicated by the appended claims rather than by the foregoing description. All changes which come within the meaning and range of equivalency of the claims are to be embraced within their scope as well.

What is claimed is:

1. An opening system for use in a tilt-up wall system, the opening system comprising:

a lower bracket including a substantially planar mounting portion with apertures for mounting to a surface, a first portion extending from the mounting portion and a first lip extending from the first portion, a second portion extending from the mounting portion and a second lip extending from the second portion, the first and second lips lying in planes substantially perpendicular to the mounting portion;

two corner members rigidly held in place at a selected angle, $0° < \phi < 180°$, relative to each other, by the first and second lips of the lower bracket;

spacer members configured to butt against the corner members; and lower supports configured for mounting on the surface and receiving the lower bracket adjacent to the first and second portions, the corner members and the spacer members held in a rigid position to form an opening within a tilt-up wall.

2. The opening system according to claim 1, wherein the two corner members are configured for being joined in a miter joint or a butt joint.

3. The opening system according to claim 1, wherein the selected angle, $\phi$, comprises about 90 degrees.

4. The opening system according to claim 1, wherein each of the lips is mounted against one of the corner members, the lips further configured in the selected angle, $\phi$, with respect to each other.

5. The opening system according to claim 1, further comprising an angle bracket configured to rigidly hold the two corner members at the selected angle with respect to each other.

6. The opening system according to claim 1, wherein the spacer members each comprise substantially rectangular cross-sectioned structures having selectable length.

7. The opening system according to claim 6, wherein the spacer members comprise substantially hollow aluminum structures.

8. The opening system according to claim 1, wherein the lower supports each comprise a channel for receiving an edge of a spacer member or a corner member.

9. The opening system according to claim 1, wherein the lower supports each comprise angular portions configured for forming a chamfer along an edge of the opening.

10. The opening system according to claim 9, wherein the first and second portions are each disposed against one of the angular portions of each of the lower supports.

11. The opening system according to claim 1, further comprising upper supports, each upper support comprising a channel for receiving an edge of a spacer member or a corner member.

12. A tilt-up wall system, comprising:

forms defining an outer boundary of a tilt-up wall; and at least one opening system configured to define an opening within the outer boundary of the tilt-up wall, each of the at least one opening systems, comprising:

corner assemblies, each corner assembly comprising:

two corner members rigidly held in place at a selected angle, $0°<\phi<180°$, with respect to each other;

a lower bracket including a substantially planar mounting portion with apertures for mounting to a surface, a first portion extending from the mounting portion and a first lip extending from the first portion, a second portion extending from the mounting portion and a second lip extending from the second portion, the first and second lips lying in planes substantially perpendicular to the mounting portion; and the first and second lips mounted to the two corner members;

spacer members configured to cooperate with the corner assemblies; and lower supports configured for mounting on a surface and receiving and holding the corner assemblies and spacer members in a rigid position to form an opening within a tilt-up wall system.

13. The tilt-up wall system according to claim 12, further comprising upper supports configured for receiving the corner assemblies and spacer assemblies opposite the lower supports.

14. The tilt-up wall system according to claim 13, wherein the upper supports and the lower supports each comprise angular portions configured to form a chamfer along an edge of the opening.

15. The tilt-up wall system according to claim 14, wherein the first and second portions are each disposed against one of the angular portions of each of the lower supports.

16. The tilt-up wall system according to claim 12, wherein the two corner members are configured for being joined in a miter joint or a butt joint.

17. The tilt-up wall system according to claim 12, wherein the corner assemblies each further comprise an angle bracket configured for holding the two corner members at the selected angle, $\phi$.

18. The tilt-up wall system according to claim 12, wherein the selected angle comprises about 90 degrees.

19. The tilt-up wall system according to claim 12, wherein the lips lie in planes oriented at the selected angle, $\phi$, with respect to each other.

20. A method of forming a tilt-up wall having an opening, comprising:

providing a tilt-up wall system, comprising:

forms defining an outer boundary of a tilt-up wall; and an opening system configured to define an opening within the outer boundary of the tilt-up wall, each of the at least one opening systems, comprising:

corner assemblies, each corner assembly comprising:

two corner members rigidly held in place at a selected angle, $0°<\phi<180°$, with respect to each other;

a lower bracket including a substantially planar mounting portion with apertures for mounting to a surface, a first portion extending from the mounting portion and a first lip extending from the first portion, a second portion extending from the mounting portion and a second lip extending from the second portion, the first and second lips lying in planes substantially perpendicular to the mounting portion; and the first and second lips mounted to the two corner members;

spacer members configured to cooperate with the corner assemblies;

lower supports configured for mounting on a surface and receiving and holding the corner assemblies and spacer members in a rigid position to form an opening within a tilt-up wall system; and upper supports configured for receiving the corner assemblies and spacer assemblies opposite the lower supports;

securing the lower supports to the surface;

inserting the corner assemblies and spacer members;

placing the upper supports on top of the corner assemblies and spacer members;

arranging the forms around the opening system to define the outer boundary of the tilt-up wall; and pouring concrete into a region outside of the opening system and inside of the forms.

21. The method according to claim 20, further comprising curing the concrete.

22. The method according to claim 20, further comprising hardening the concrete.

23. The method according to claim 20, wherein the first and second portions are each disposed against the one of the angular portions of each of the lower supports.

* * * * *